US006896606B1

(12) United States Patent
Turgeon et al.

(10) Patent No.: US 6,896,606 B1
(45) Date of Patent: May 24, 2005

(54) DRYWALL SANDING IMPLEMENT

(76) Inventors: Robert J. Turgeon, P.O. Box 255, Wallingford, VT (US) 05773; Clifford F. Dawson, P.O. Box 339, Wallingford, VT (US) 05773

( * ) Notice: Subject to any disclaimer, the term of this patent is extended or adjusted under 35 U.S.C. 154(b) by 0 days.

(21) Appl. No.: 09/169,607

(22) Filed: Oct. 9, 1998

(51) Int. Cl.[7] ..... B24D 15/00

(52) U.S. Cl. ..... 451/524; 451/458; 451/459; 451/495; 451/504; 451/523; 451/524; 451/529; 451/530

(58) Field of Search ..... 451/458, 459, 451/495, 504, 523, 524, 525, 529, 530

(56) References Cited

U.S. PATENT DOCUMENTS 3,483,662 A * 12/1969 Ames
5,179,807 A * 1/1993 Gupton
5,402,559 A * 4/1995 Allison et al.
5,567,197 A * 10/1996 Evensen
6,003,505 A * 12/1999 Dalton et al.

* cited by examiner

*Primary Examiner*—Joseph J. Hail, III
*Assistant Examiner*—Shantese McDonald
(74) *Attorney, Agent, or Firm*—Kevin Ellicott, Esq.

(57) ABSTRACT

A drywall sanding implement having a shaft, a yoke attached to the shaft, a block pivotably mounted to the yoke, a pair of spindles mounted to the block, and a sanding block removably mounted on each spindle.

7 Claims, 2 Drawing Sheets

DRYWALL SANDING IMPLEMENT

CROSS REFERENCE TO OTHER APPLICATIONS

This application claims the benefit of a U.S. Provisional Application filed by Express Mail, Number FF851564952US, on Oct. 21, 1997.

FEDERALLY SPONSORED RESEARCH AND DEVELOPMENT

There are no federally sponsored or funded research or development projects or undertakings in any way associated with the instant invention.

BACKGROUND OF THE INVENTION

1. Field of the Invention

The present invention is for a drywall sanding implement and an abrasive pad for use with the same. The drywall sanding implement has particular utility for smoothing joints in drywall construction.

2. Background Information

Sanding poles are frequently used for smoothing joints in drywall construction. During construction, the joints between the panels of drywall are filled with joint compound. The joint compound is allowed to dry, and then abraded with sandpaper to achieve a smooth wall surface. A sanding pole allows the user to sand joints from floor to ceiling level without the need for stepladders or other devices to reach the upper portions of the joints. Such sanding poles typically employ sandpaper mounted to a planar member, which in turn is mounted to one end of a shaft by means of a universal joint. The universal joint allows the planar member to pivot relative to the shaft in two orthogonal planes. Examples of such devices appear to be taught in U.S. Pat. Nos. 4,516,361; 4,848,037; and 4,885,876.

One problem with such devices is that the long shaft is unwieldy, making sanding in tight areas difficult. The '037 patent appears to teach interchangeable pole and hand mountings for the planar member, the hand mounting allowing for hand sanding in tight areas. However, such interchangeability requires complicated structure and appears to be prone to breakage under heavy usage.

A problem with all such devices is the use of sandpaper. When used for smoothing drywall joints, sandpaper quickly loses its abrasive capability, and is prone to tearing on electrical junction boxes or other protrusions from the drywall surface. The effort required to replace the sandpaper is often considerable, since it is typically retained on the planar member by some sort of clamping means.

As an alternative to sandpaper, abrasive sponges have been developed to provide longer lasting abrasive capability. U.S. Pat. No. 4,263,677 appears to teach the use of an abrasive sponge incorporated into a mitt for smoothing drywall joints. While abrasive sponges generally retain their abrasive capacity longer than sandpaper, the shape of such sponges does not allow them to be mounted to conventional sanding poles to allow the user greater reach.

Additionally, when abrasive sponges are used for smoothing drywall joints, they frequently result in scarring, particularly when used in corners. The sponges typically have a parallelogram-shaped cross section, which is generally rectangular. Because the abrasive coating tends to stiffen the sponge. When one side of the sponge is used to sand a joint, the center of the side deforms more than the edges, since the edges are stiffened by the abrasive coating on the adjacent sides. Thus, the edge which is distant from the corner tends to resist deformation, and abrades a scar parallel to the corner as the joint is sanded.

Thus, there is a need for a sanding pole which can incorporate the advantages of sponge-type abrasive articles, and which allows for rapid transition between pole-type sanding and hand sanding. There is also a need for a sponge-type abrasive article which can be used to sand corners without risk of scarring.

SUMMARY OF THE INVENTION

The present invention provides a drywall sanding implement for use with a shaft having a first end and a second end. Such shafts are commercially available for use with conventional sanding pole attachments paint applicators, etc. Alternatively, the drywall sanding implement may employ an integral shaft.

A block is pivotably mounted to the first end of the shaft. When a conventional shaft is employed, the block is pivotably mounted to a yoke, which in turn is attached to the first end of the shaft. An axle is mounted to the block.

A first spindle is rotatably mounted to the axle. A first pad is provided, which has a first pad mounting passage therethrough which is configured to frictionally engage the first spindle. In this manner, the first pad is releasably attached to the first spindle, and can be readily removed for replacement or for use by hand in tight spaces. The first pad is also free to rotate with respect to the block. Preferably, the axis of rotation of the first spindle will be substantially normal to the axis about which the block is pivotably mounted to the shaft.

Similarly, a second spindle is rotatably mounted to the axle, and a second pad is releasably attached to the second spindle. The second pad has a second pad mounting passage therethrough which is configured to frictionally engage the second spindle.

Preferably, the first pad and the second pad are both abrasive pads having a body of a compressible material. The body has an outer surface, and typically has a substantially parallelogram-shaped cross section having a first pair of opposed corners. The substantially parallelogram-shaped cross section may be substantially rectangular, but it is preferred for it to be non-rectangular, such that the first pair of opposed corner are obtuse angles and the second pair of opposed corners are acute angles. The first pad mounting passage and the second pad mounting passage are each substantially normal to the substantially parallelogram-shaped cross section.

An abrasive coating is applied to the outer surface of the body. Preferably, the body and the abrasive coating are configured with respect to each of the first pair of opposed corners of the substantially parallelogram-shaped cross section so as to prevent contact of the abrasive coating at each of the first pair of opposed corners with a surface being abraded. Such a configuration minimizes the chances of the surface being abraded becoming scarred or gouged by one of the first pair of opposed corners.

One configuration of the body and abrasive coating which has been found effective in preventing scarring, when the cross section of the body is a parallelogram, is to make the abrasive coating discontinuous at each of the first pair of opposed corners. This may be accomplished by making the abrasive coating discontinuous per se, or by making the coating continuous while eliminating the abrasive grains at the first pair of opposed corner. Alternatively, the substantially parallelogram-shaped cross section of the body may be a modified parallelogram such that the first pair of opposed corners are rounded or faceted. These configurations will also reduce scarring when the abrasive pad is removed from its respective spindle and used for hand sanding.

While the drywall sanding implement has particular utility for use smoothing joints in drywall construction with abrasive pads, the ability to readily replace the first and second pads allows the implement to have great versatility. As an example, the first pad and the second pad could be replaced by pads designed for furnace cleaning, by providing such pads with mounting passages to allow them to frictionally engage the first and second spindles. Similarly, sponge pads designed for application of paint may be provided with mounting passages to allow the drywall sanding implement to be used for painting.

A DESCRIPTION OF THE DRAWINGS

A DESCRIPTION OF THE PREFERRED EMBODIMENT

Figure 1:
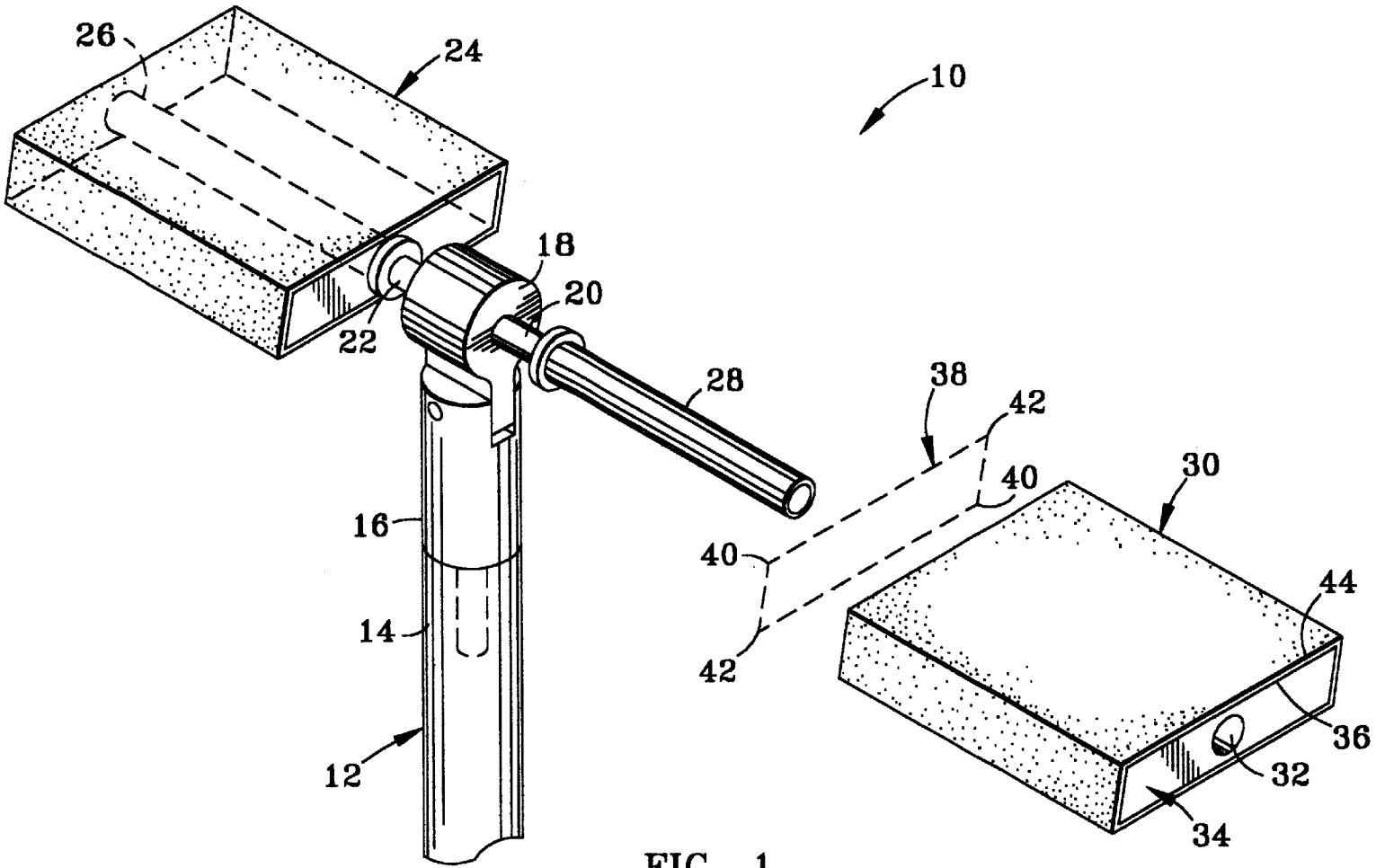
FIG. 1 is a perspective view of instant invention.

FIG. 1 illustrates one embodiment of the present invention, a drywall sanding implement 10. The drywall sanding implement 10 is designed for attachment to a shaft 12 having a first end 14.

The drywall sanding implement 10 has a yoke 16 which is attachable to the first end 14 of the shaft 12. A block 18 is pivotably mounted to the yoke 16.

An axle 20 is mounted to the block 18. A first spindle 22 is rotatably mounted to the axle 20. The first spindle 22 may be retained on the axle 20 by means of a cotter pin, E-clip, or various other means well known in the art.

A first pad 24 is provided, which has a first pad mounting passage 26 therethrough. The first pad mounting passage 26 is configured to frictionally engage the first spindle 22, allowing the first pad 24 to readily be removed or replaced onto the first spindle 22.

Similarly, a second spindle 28 is also rotatably mounted to the axle 20. A second pad 30 having a second pad mounting passage 32 therethrough is provided, and the second pad mounting passage 32 is configured to frictionally engage the second spindle 28. In FIG. 1, the second pad 30 is shown removed from the second spindle 28.

The first pad 24 and the second pad 30 of the drywall sanding implement 10 may be similar in composition to any of a variety of abrasive pads used for sanding drywall and similar materials. Since the first pad 24 and the second pad 30 will typically be similar in construction, only details of the structure of the second pad 30 will be discussed.

The second pad 30 has a body 34 which is formed of a compressible material. The body 34 has an outer surface 36, and has a substantially parallelogram-shaped cross section 38. In the second pad 30, the substantially parallelogram-shaped cross section 38 is rectangular, having a first pair of opposed corners 40 and a second pair of opposed corners 42. The substantially parallelogram-shaped cross section 38 is substantially normal to the second pad mounting passage 32 of the second pad 30. An abrasive coating 44 is applied to the outer surface 36 of the body 34.

Figure 2:
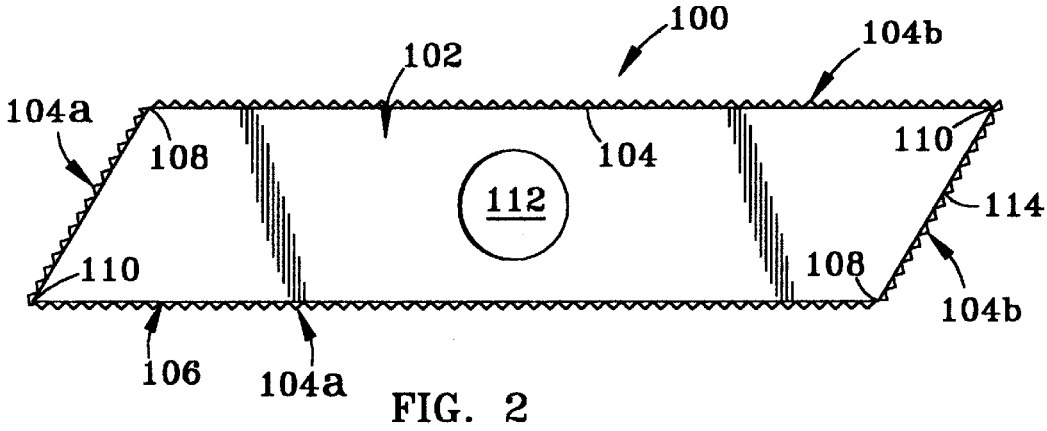
FIG. 2 is a cross-sectional view of a first embodiment of the sanding pad.

FIG. 2 illustrates an alternative abrasive pad 100 which can be employed in place of either or both of the first pad 24 and second pad 30 shown if FIG. 1. The abrasive pad 100 again has a body 102 of a compressible material having an outer surface 104. The body 102 of a substantially parallelogram-shaped cross section 106 having a first pair of opposed corners 108 and a second pair of opposed corners 110. In the abrasive pad 100, the substantially parallelogram-shaped cross section 106 is nonrectangular, such that the first pair of opposed corners 108 are obtuse angles and the second pair of opposed corners 110 are acute angles.

The body 102 has a mounting passage 112 which is substantially normal to the substantially parallelogram-shaped cross section 106.

An abrasive coating 114 is applied to the outer surface 104 of the body 102. To minimize gouging, the abrasive coating 114 is discontinuous at each of the first pair of opposed corners 108 of the substantially parallelogram-shaped cross section 106.

Preferably, the abrasive coating 114 is a dual-grit abrasive coating, such that the grit of the abrasive coating 114 for a first outer surface section 104*a* is different than the grit for a second outer surface section 104*b*. When a pad such as the abrasive pad 100 having a dual-grit abrasive coating 114 is employed for the first pad 24 and the second pad 30, it is typically preferred for the first pad 24 and the second pad 30 to be arranged reverse of each other, such that the corresponding sections of their outer surfaces have different grit.

Figure 3:
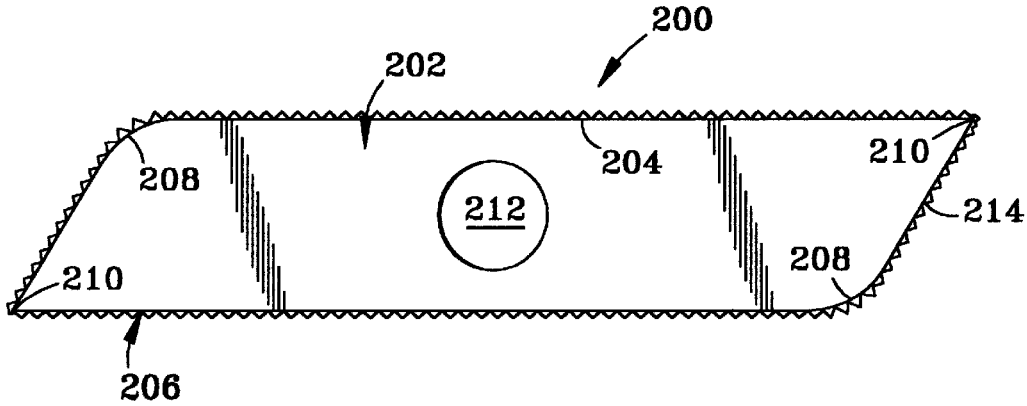
FIG. 3 is a cross-sectional view of a second embodiment of the sanding pad.

FIG. 3 illustrates another alternative abrasive pad 200 which has many features in common with the abrasive pad 100 shown in FIG. 2. The abrasive pad 200 again has a body 202 having an outer surface 204. The body 202 has a substantially parallelogram-shaped cross section 206 having a first pair of opposed corners 208 and a second pair of opposed corner 210.

In the abrasive pad 200, the substantially parallelogram-shaped cross section 206 is a modified parallelogram such that the first pair of opposed corner 208 are rounded to prevent gouging. The body 202 has a mounting passage 212, and an abrasive coating 214 is applied to the outer surface 204.

Figure 4:
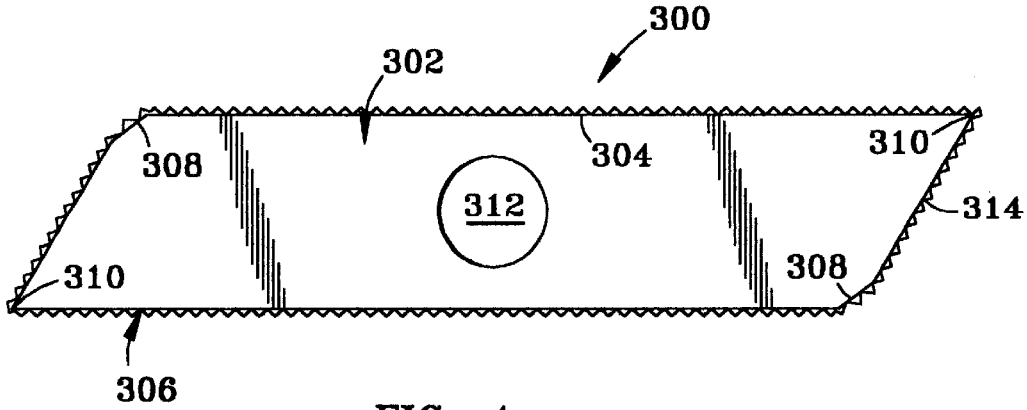
FIG. 4 is a cross sectional view of a third embodiment of the sanding pad.

FIG. 4 illustrated yet another alternative abrasive pad 300 which also can be employed in place of either or both of the first pad 24 and second pad 30 shown in FIG. 1. The abrasive pad 300 again has a body 302 having and outer surface 304, the body 302 having a substantially parallelogram-shaped cross section 306. The substantially parallelogram-shaped cross section 306 has a first pair of opposed corners 308, which are faceted to prevent gouging, and a second pair of opposed corners 310. The body 302 again has a mounting passage 312 and an abrasive coating 314 applied to the outer surface 304.

While the novel features of the present invention have been described in terms of particular embodiments and preferred applications, it should be appreciated by one skilled in the art that substitution of materials and modification of details obviously can be made without departing from the spirit of the invention.

What is claimed is:

1. A drywall sanding implement for attachment to a shaft having a first end and a second end, the drywall sanding implement comprising:

a yoke which is attachable to said first end of said shaft;

a block pivotably mounted to said yoke;

an axle mounted to said block;

a first spindle rotatably mounted to said axle;

a first pad having a first pad mounting passage therethrough which is configured to frictionally engage said first spindle;

a second spindle rotatably mounted to said axle; and a second pad having a second pad mounting passage therethrough which is configured to frictionally engage said second spindle;

the first pad and second pad each having a body of compressible material having an outer surface, said body having a substantially parallelogram-shaped cross section having a body of a compressible material having an outer surface, said body having a substantially parallelogram-shaped cross section having a first pair of opposed corners and a second pair of opposed corners, said first mounting passage of said first pad and said second mounting passage of said second pad each being substantially normal to said substantially parallelogram-shaped cross section; and an abrasive coating applied to said outer surface of said body, wherein said body and said abrasive coating are configured with respect to each of said first pair of opposed corners of said substantially parallelogram-shaped cross section so as to prevent contact of said abrasive coating at each of said first pair of opposed corners with a surface being abraded.

2. The drywall sanding implement of claim 1 wherein said substantially parallelogram-shaped cross section of each of said first pad and said second pad is non-rectangular, such that said first pair of opposed corner are obtuse angles and said second pair of opposed corners are acute angles.

3. The drywall sanding implement of claim 2 wherein said abrasive coating is discontinuous at each of said first pair of opposed corners of said substantially parallelogram-shaped cross section.

4. The drywall sanding implement of claim 2 wherein said substantially parallelogram-shaped cross section of each of said first pad and said second pad is a modified parallelogram such that said first pair of opposed corners are rounded.

5. The drywall sanding implement of claim 2 wherein said substantially parallelogram-shaped cross section of each of said first pad and said second pad is a modified parallelogram such that said first pair of opposed corner are faceted.

6. A drywall sanding implement comprising:

a shaft having a first end and a second end;

a block pivotably mounted to said first end of said shaft;

an axle mounted to said block;

a first spindle rotatably mounted to said axle;

a first pad having a first pad mounting passage therethrough which is configured to frictionally engage said first spindle;

a second spindle rotatably mounted to said axle; and a second pad having a second pad mounting passage therethrough which is configured to frictionally engage said second spindle.

7. A drywall sanding implement for attachment to a shaft having a first end and a second end, the drywall sanding implement comprising:

a yoke which is attachable to said first end of said shaft;

a block pivotably mounted to said yoke;

an axle mounted to said block;

a first spindle rotatable mounted to said axle;

a first pad having a first pad mounting passage therethrough which is configured to frictionally engage said first spindle;

a second spindle rotatably mounted to said axle; and a second pad having a second pad mounting passage therethrough which is configured to frictionally engage said second spindle.

* * * * *